US010370793B2

(12) United States Patent
Khu

(10) Patent No.: US 10,370,793 B2
(45) Date of Patent: Aug. 6, 2019

(54) STRANDING MACHINE

(71) Applicant: Peter Khu, Vienna (AT)

(72) Inventor: Peter Khu, Vienna (AT)

( * ) Notice: Subject to any disclaimer, the term of this patent is extended or adjusted under 35 U.S.C. 154(b) by 379 days.

(21) Appl. No.: 15/110,341

(22) PCT Filed: Jan. 15, 2015

(86) PCT No.: PCT/IB2015/000032
§ 371 (c)(1),
(2) Date: Jul. 15, 2016

(87) PCT Pub. No.: WO2015/107414
PCT Pub. Date: Jul. 23, 2015

(65) Prior Publication Data

US 2016/0333518 A1 Nov. 17, 2016

(30) Foreign Application Priority Data

Jan. 15, 2014 (CH) ..... 0045/14
Aug. 8, 2014 (CH) ..... 1208/14

(51) Int. Cl.
*D07B 3/04* (2006.01)
*H01B 13/02* (2006.01)

(52) U.S. Cl.
CPC ..... *D07B 3/04* (2013.01); *H01B 13/0235* (2013.01); *D07B 2501/406* (2013.01)

(58) Field of Classification Search
CPC . D07B 3/04; D07B 2501/406; H01B 13/0235
See application file for complete search history.

(56) References Cited

U.S. PATENT DOCUMENTS 2,147,065 A * 2/1939 Somerville ..... D07B 3/04 475/11
2,162,131 A * 6/1939 Somerville ..... D07B 3/04 57/58.32

(Continued)

FOREIGN PATENT DOCUMENTS

CN 203218041 U 9/2013
DE 572183 C 3/1933

OTHER PUBLICATIONS

International Search Report dated Apr. 2, 2015, from parent application PCT/IB2015/000032 with English translation.

(Continued)

*Primary Examiner* — Shaun R Hurley
(74) *Attorney, Agent, or Firm* — Nadya Reingand; Yan Hankin

(57) ABSTRACT

A stranding element (V) includes a stationary storage container (2) for the material to be stranded, and at least one rotating guiding device (1, 5, 6, 6*a*) for guiding the material to the stranding region (3) substantially parallel to the rotational axis of guiding device (1, 5, 6, 6*a*). The guiding device (1, 5, 6, 6*a*) is rotatably mounted in support structure (10), in particular in bearing arrangement (L). The bearing arrangement (L) lies completely within the circle of rotation of the material, and is secured to support structure (10) via a retaining arrangement (H) extending from the bearing arrangement (L) radially outwards beyond the circle of rotation of the material, and axially spaced from the guiding device (1, 5, 6, 6*a*). The retaining arrangement (H) has a passage that opens temporarily to allow the material to pass through in the circumferential direction and that follows the circle of rotation of the material.

20 Claims, 6 Drawing Sheets

(56) References Cited

Figure 1:
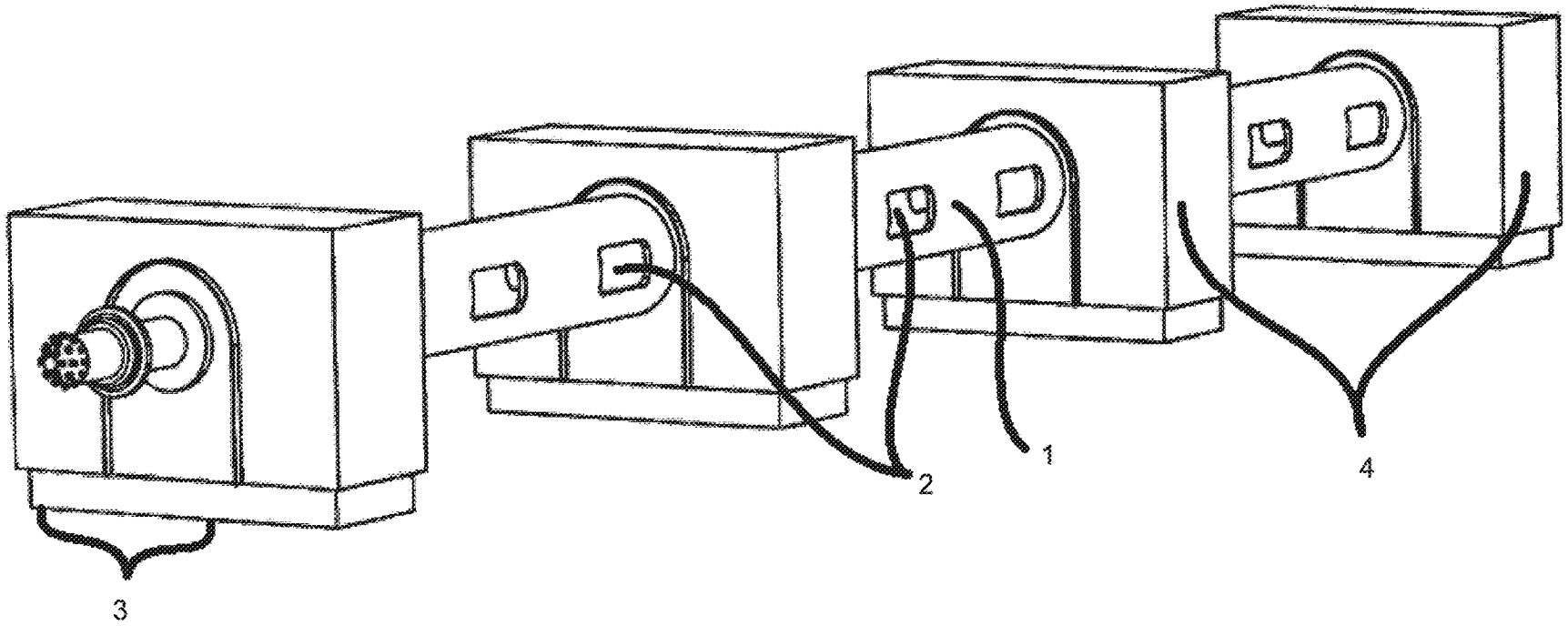
Fig. 1 PRIOR ART

U.S. PATENT DOCUMENTS 2,371,523 A 3/1945 Jones
2,416,126 A * 2/1947 Somerville ..... D07B 3/04 403/58
2,485,348 A * 10/1949 Arnason ..... D07B 3/04 57/102
2,534,696 A * 12/1950 Bruestle ..... D07B 3/04 57/58.3
2,671,303 A 3/1954 Pearce
2,723,525 A * 11/1955 Blaisdell ..... D07B 3/04 57/58.36
3,425,203 A * 2/1969 Schillebeeckx ..... D07B 3/04 140/149
3,448,569 A * 6/1969 Rose ..... D07B 3/06 57/15
3,456,433 A * 7/1969 Cloostermans-Huwaert ..... D07B 3/04 57/104
3,872,660 A * 3/1975 Gallagher-Daggitt ... D07B 1/22 505/930
3,996,653 A * 12/1976 Faris ..... B23P 6/00 29/402.05
4,300,339 A * 11/1981 Orlandi ..... D07B 3/045 57/15
4,325,214 A 4/1982 Zuber
4,640,087 A * 2/1987 Targa ..... D07B 3/04 57/58.34
4,704,854 A * 11/1987 Williams ..... D07B 7/06 57/58.32
4,785,617 A * 11/1988 Bourgois ..... D07B 3/00 57/58.52
4,903,473 A * 2/1990 Classen ..... D07B 7/02 57/15
6,543,213 B1 4/2003 Khu
8,915,113 B2 12/2014 Mattheisl et al.

OTHER PUBLICATIONS

International Preliminary Report on Patentability, dated Apr. 2, 2015, from parent application PCT/IB2015/000032; original German-language version.
Article titled "Niederösterreicher baut erste Schnellverseilmaschine ohne Rohr," by Elisabeth Biedermann, in Factory magazine (Austria), Internet online at https://factorynet.at/a/khu-niederoesterreicher-baut-erste-schnellverseilmaschine-ohne-rohr, Jul. 29, 2014, in German, with machine-translation to English.
Article titled "Khu Sondermaschinen: Hagenbrunner lässt Maschinen schweben ," by Elisabeth Biedermann, in Factory magazine (Austria), Internet online at https://factorynet.at/a/khu-sondermaschinen-hagenbrunner-laesst-maschinen-schweben, May 18, 2016, in German, with machine-translation to English.

* cited by examiner

STRANDING MACHINE

This application is a 35 U.S.C. 371 national-phase entry of PCT International application no. PCT/IB2015/000032 filed on Jan. 15, 2015 and also claims benefit of priority to prior Swiss national application no. CH 01208/14 filed on Aug. 8, 2014 and to prior Swiss national application no. CH 00045/14 filed on Jan. 15, 2014, and parent PCT International application no. PCT/IB2015/000032 is incorporated herein by reference in its entirety for all intents and purposes, as if identically set forth in full herein.

The present disclosure relates to stranding elements including at least one substantially stationary storage container for the material to be stranded and including at least one rotating guiding device for the material in order to guide the material from the storage container in the direction of the stranding region substantially parallel to the rotational axis of the guiding device, wherein the guiding device is rotatably mounted in a support structure. The present disclosure also relates to stranding machines including a plurality of storage containers, which are substantially stationary during operation, for the material to be stranded and including at least one rotating guiding device for the material in order to guide same from each of the storage containers to a common stranding region.

A stranding machine is an apparatus, via which electrical lines, steel, copper and aluminum wires, for example, as well as insulated conductors, that include a plurality of individual conductors, are twisted to form cables. The shape of the cable is determined by the number of the individual conductors, the arrangement of the individual conductors, and the length of twist. Simplest machines include a coil carrier, around which a rotor including the individual conductors moves. The length of twist is determined as a function of rotor and coil speed. Many coil carriers, which only allow for the production of thin cables, are thereby arranged on the rotor. Other designs of stranding machines, such as in particular tubular stranding machines, must be used for thicker cables and in particular thick and heavy material to be stranded.

Tubular stranding machines include welded bearing stands, in which a stranding tube is stored in a central bearing. Coil carriers for the material to be stranded are mounted in a substantially stationary manner, but typically so as to oscillate, in the course of the stranding tube. The material is guided from the coil carriers to the exterior of the stranding tube, and is guided from there to the stranding region along the tube. Due to their large length, these stranding machines require a very large amount of space, are extensive and cannot easily be expanded, as needed, if cables are to be produced from a number of conductors, that is larger than the number of the available coil carriers. If, on the other hand, cables are to be produced from a number of individual conductors, that is smaller than the number of the coil carriers which the tubular stranding machine has, the entire tube must nonetheless be moved, leading to unnecessary effort and energy consumption and thus also to increased production costs for the cable.

It is thus within the scope of the present disclosure to specify stranding machines, via which thick and heavy material may be stranded as well, and that may be flexibly adapted to the respective stranding task in a simple manner, in particular with regard to the number of the individual conductors, that are to be stranded. The object may be solved via features within the scope of the present disclosure. Advantageous further developments are specified in the figures and in the remaining disclosure.

According to the present disclosure, at least one guiding device is rotatably mounted by means of a bearing arrangement, which bearing arrangement lies completely within the circle of rotation of the material and is secured to the support structure via at least one retaining arrangement, which extends from the bearing arrangement radially outwards beyond the circle of rotation of the material and which is axially spaced apart from the guiding device. This retaining arrangement has at least one passage, that opens temporarilty in order to allow the material to pass through in circumferential direction, and that follows the circle of rotation of the material.

The large and voluminuous bearing stands required for tubular stranding machines, for example, can thus be foregone. The mounting of the rotating parts may be accomplished in central bearing arrangements, that are structurally simple, compact and functionally reliable even in response to high angular velocities, for the bearing axes, which structurally coincide with the rotational axis of the rotating parts.

Preferably, the guiding device comprises a stranding disk, that is rotatably mounted in the bearing arrangement, comprising at least one guide for the material to be stranded. Such disks have a smaller rotative moment of inertia, so that the guiding device for the material to be stranded may be accelerated more quickly, and may also be decelerated more quickly and with less effort in case of an emergency, as well as upon ending the production.

To prevent damages to the material to be stranded and to ensure a more accurate guiding, a guiding tube thereby preferably extends from each guide, typically a hole permeating the stranding disk, on the side of the stranding disk opposite the retaining arrangement. This guiding tube is supported in an auxiliary stranding disk of the stranding element or of a further stranding element, which follows in the direction of the rotational axis.

Even though the rotational moment of inertia is higher, it may be advantageous for some uses, for aerodynamic reasons, for at least one guiding tube to be devised in the wall of a cylinder tube, wherein the rotational axis of the cylinder tube is rotatably mounted in a bearing arrangement on at least one front side.

An advantageous version is characterized in that the retaining arrangement has a central region, preferably a disk, preferably parallel to a possible stranding disk, and includes a substantially circular circumferential edge including a smaller radius than the circle of rotation of the material, wherein the central disk is retained in a stationary and rotational manner in a support structure located radially outside of the circle of rotation via at least two retaining devices, wherein at least one of the retaining devices always retains the central disk and each retaining device, in the vicinity of which a guide for the material is currently located, releases a passage gap for the material to be stranded. This ensures a stable fixation of the compact, central bearing arrangement. A particularly good positional fixation leads to an arrangement comprising at least three retaining devices, at least two of which always retain the central disk.

A preferred alternative of this retaining arrangement provides for the central region of the retaining arrangement to be fixed in a stationary and rotatably fixed manner in a retaining ring located radially outside of the circle of rotation via a plurality of retaining elements, that are preferably arranged so as to be distributed evenly along the circumference of the retaining ring, wherein at least two retaining elements always connect the central disk to the retaining ring, and each retaining element, in the vicinity of which a guide for the material is currently located, is moved out of the region of the circle of rotation of the material, and releases a passage gap for the material to be stranded.

According to a first version, the retaining element is embodied as pin, that may be moved substantially radially and in its longitudinal extension and that is mounted in the central disk or the retaining ring, and that engages with corresponding holes in the radially opposite component in retained position, wherein the retaining element is preferably pretensioned towards the retained position.

At least in the region of the guide, the stranding disk is thereby preferably provided with a cam-shaped structure or a positive guide, that brings the retaining element located upstream of the guide in rotational direction from its retained position out of the region of the circle of rotation, as soon as the guide passes the retaining element and retains the retaining element in retained position, preferably beyond the remaining circumferential region. It is ensured with this that the central region including the bearing arrangement is always retained and fixed securely by at least one or preferably by an entire group of retaining elements, so that the calm and stable course of the stranding disk is ensured. For this purpose, the positive guide cooperates with the respective retaining element located upstream of the guide in rotational direction via a slide element, that is guided in this positive guide or which abuts thereon continuously, or with a roller, that runs thereon, so as to radially actuate said element, that is connected to the retaining element, or this roller independent from the angular position of the stranding disk and so as to thus bring the retaining element from its retained position into a position, which is spaced apart from the retaining and guiding ring, solely when the guide passes the retaining element, and to retain the retaining element in retained position via the remaining circumferential region, so as to ensure the desired secure retaining function of the retaining elements as well as the release thereof of a passage for the material to be stranded when the latter revolves around the stranding disk.

According to another version, the retaining arrangement includes a central region, preferably a central star-shaped or triangular disk or a spoke-shaped structure, respectively, which central region is retained in the support structure in a stationary and rotatably fixed manner via a plurality of radially outward retaining devices, which extend from the central bearing arrangement substantially radially outwards via retaining devices extending beyond the circle of rotation, wherein these retaining devices are preferably arranged so as to be distributed evenly in circumferential direction of the retaining arrangement in the region of the circle of rotation of the material, and wherein the retaining devices support the central disk in the support structure at any point in time, yet thereby allowing the material to pass through in circumferential direction. This design ensures the optimal retaining effect on the central region for the stranding disk via the bearing arrangement, which ensures the smooth running thereof even in response to high speeds.

To ensure the secure, continuous retaining and to nonetheless allow the material to be stranded to pass through on the circle of rotation thereof in the context of the rotation of the stranding disk, each connecting arrangement according to the present disclosure includes at least one roller, that is rotatably secured on the central region or on the support structure, preferably a plurality of rollers spaced apart in circumferential direction of the retaining arrangement. The axes of all of the rollers are oriented parallel to one another and preferably parallel to the rotational axis of the stranding element, and the contact points of the outermost rollers with an opposite roller are located on opposite sides in circumferential direction of a radial connecting line between the rotational axis and the opposite roller. The device-related and control-related effort for radially movable retaining elements and the temporary lifting thereof from the retaining structure may be avoided with this. The continuous retaining effect, which is also always constant in the radial direction, may furthermore be ensured with this at every position.

To make it possible for the material to be stranded to pass through the retaining arrangement without squeezing this material between the rollers or striking radial blows to these rollers, provision is advantageously made according to the present disclosure on the outer circumference of a roller, which protrudes into the circle of rotation of the material for at least one recess, which has a dimension to allow the material to be capable of being received in this recess and to be capable of being transported past the rollers in the course of the rotation of the roller, without hindering and preferably without contact to the contacting opposite rollers. Preferably, provision is made for two or a plurality of such recesses. The material, which comes into the region of the rollers of the retaining arrangement, on the outer circumference of the stranding element, enters into the recess of the roller, which recess has the same circumferential speed as the stranding element and thus also the material to be stranded in response to the rotation of the roller. The material and the recess thus continue to move at the same circumferential speed without impacting one another in the region of overlap of the circles, on which they move, until the material has passed the retaining arrangement and may then exit from the recess, which also rotates.

To make it possible to carry out the above-explained unhindered guide-through of the material, but to ensure the secure retaining effect and a calm, impact-free movement of the stranding disk and always the best-possible contact of the opposite rollers of the retaining arrangement for every orientation of the recess relative to the direction of movement of the material, the expansion of the recess in circumferential direction of the roller preferably extends parallel to the rotational axes of the rollers beyond a region, which maximally corresponds to the smallest distance of the contact points of two adjacent opposite rollers with this roller including the recess, so that the roller including the recess is in contact with at least one of two opposite adjacent rollers at any point in time.

In contrast, an alternative version provides for the recess in the roller to run at an incline yet equidistantly as compared to the rotational axis, wherein the limitations of the recesses in circumferential direction of the roller are spaced apart by at least the circumferential width of the recess, and the roller is in contact with every opposite roller at every point in time. This type of design provides for a continuous mutual contact of only two rollers, because, as viewed across the width of the roller comprising the recess, one region of the opposite roller is always contacted and is supported thereon. A calm, impact-free movement while nonetheless making it possible for the material revolving on the circle of rotation to pass through, is ensured with this, albeit with a certain deviation from the transport direction of the material in the region upstream of and downstream from the respective retaining arrangement.

At least the rollers comprising the recess, preferably also the opposite rollers, may preferably be driven with an angular velocity, which is proportional to the angular velocity of the guiding element, wherein a functional drive-related connection, for example using toothed belts or the like, exists between the drive of the stranding disk and the rollers. The recesses may thus always be retained in the respective optimal position relative to the material to be stranded, so as to ensure the careful entering and exiting into or out of the recess, respectively, as well as also the passing of every roller arrangement as carefully as possible, preferably without direct contact with any of the rollers, for the material.

For the simple and secure energy supply of the individual structural units of the stranding machine, as well as for the optimal process control and monitoring, provision may preferably be made for at least one of the retaining arrangements to be designed to electrically contact the support element and other components or component groups, if applicable, of the stranding element, and for either at least one roller of the support element to be designed with current consumers and/or sensor systems and/or actuators on the stranding element or for at least one roller of the support structure, respectively, or for at least one of the retaining elements to be designed to electrically connect the retaining ring to the central region, and for the retaining and guiding ring to be connected to current consumers and/or sensor systems and/or actuators on the stranding element or for the at least one retaining element to be connected to current and/or data lines of and/or to external current sources, evaluation, control or display units or the like, respectively.

According to a further version, the stranding element may have a retaining arrangement, wherein the central region is retained in a stationary and rotatably fixed manner in a support structure located radially outside of the circle of rotation via at least one retaining device, wherein each retaining device includes at least one bearing including an air gap, preferably a magnetic bearing, the air gap of which extends along the circle of rotation of the material. This information also includes arrangements including a straight air gap, which is located tangentially to the circular circle of rotation. Without complicated mechanical systems, the contact-free, preferably magnetic mounting ensures the unhindered passage of the material to be stranded through the retaining devices, wherein, depending on the intensity of the magnets or of the air quantity, the cross section of the passage for the material may be set or actively adapted at the circle of rotation, when active magnets are used.

At best, an aerostatic or aerodynamic air bearing may also be used instead of the magnetic bearing. In principle, air bearings are slide bearings, in the case of which the compressed air, which is pressed into the bearing gap between the slide surfaces that are moved towards one another, forms the lubricating medium. With this, a pressure cushion is simultaneously established, which bears the load of the mounted component in a contact-free manner. A differentiation is made between aerodynamic bearings, that establish the air cushion by the movement itself, and aerostatic bearings, in the case of which compressed air is introduced for establishing the pressure cushion. Typically, the compressed air is provided by a compressor, wherein a level, which is as high as possible, is desired for the pressure, the stiffness and the attenuation of the air cushion. In contrast, aerodynamic bearings do not require a compressed air supply, but have the problem that the two bearing partners touch one another below a characteristic relative speed (linearly or rotatively) and thus have friction, which leads to wear.

Preferably, at least one of the magnetic bearings extends along a circumferential section of the stranding disk, and the air gap thereof follows the circle of rotation of the material across a corresponding circumferential section.

It is advantageous, when at least one of the magnetic bearings is embodied as active magnetic bearing, because in this case, the retaining force as well as the bearing force of the bearing of the bearing arrangement and thus also the air gap may be adjusted for the passage of the material to be stranded and—within certain limits—to the respective needs.

To conserve energy for the current feed and regulation of the active magnetic bearing, at least one of the active magnetic bearings may advantageously be combined with at least one permanent magnet, which is matched to the weight of the stranding element.

Preferably, the retaining arrangement has at least one magnetic axial bearing, so that the stranding disk may also manage with as few moved components as possible for the positioning and mounting in axial direction.

For stranding machines, the object set above may be solved in that at least one of the storage containers and a corresponding guiding device are elements of a stranding element according to one of the preceding paragraphs.

In spite of a certain number of available storage containers for the material to be stranded, and in spite of a corresponding number of guiding devices, a smaller number of these structural units may also be operated, if products including a smaller number of individual conductors are to be produced. Less energy is thus required, because only the absolutely required number of functional units must be operated, so that the production also becomes more cost-effective.

Preferably, such a stranding element may be operated and handled independent from other stranding elements and thus forms a separate functional and structural unit. Due to the combination of the functional units to structural units as well, it is ensured that an existing stranding machine including a certain number of these units may in principle be expanded arbitrarily, if cables are to be stranded from more individual conductors than is possible with the original machine. Finally, individual units of existing machines may also be dismantled and also installed again easily and quickly for maintenance, repair or replacement, because the individual units may also be handled individually and separately from all other units.

According to an advantageous version of a stranding machine, two or a plurality of the stranding elements described in the paragraphs above may be connected to one another in a rotatably fixed manner. The advantages of the simpler, more compact and more functionally reliable mounting and of the simple design of the guides for the material comprising a small moment of inertia may thus also be attained for a stranding machine including a predetermined number of storage containers and thus strands of material to be stranded. Furthermore, to further promote the simplification, the connected stranded elements may preferably also have a common drive.

A further preferred version provides for a stranding machine, in the case of which the guiding device for a plurality of storage containers, that is located closest to the stranding region is formed from a stranding tube, which is mounted so as to be capable of rotating about its longitudinal axis, in the interior of which the storage contains for the material to be stranded are preferably supported so as to oscillate relative to the stranding tube, and in the case of which the at least one further stranding element, which can be operated and handled separately and independently from the stranding tube, is provided according to one of the preceding paragraphs. This version provides for the modular expansion of existing tubular stranding machines via a number of stranding elements, which is arbitrary in principle, in order to be able to strand exactly the desired number of strands, depending on the product requirements. If, in contrast, fewer strands are to be processed than would be provided as a whole by stranding tube and stranding elements, the stranding elements that are not required may simply be turned off, decoupled and even removed, if needed.

Further advantages, features and details within the scope of the present disclosure follow from the description below, in which exemplary embodiments are described by referring to the drawings. The features mentioned in the claims and in the description can thereby in each case be significant, either individually or in any combination.

The list of reference numerals is part of the disclosure. The figures will be described together and comprehensively. The same reference numerals signify the same components, reference numerals comprising different indices specify components, which are functionally equal or similar.

Figure 2:
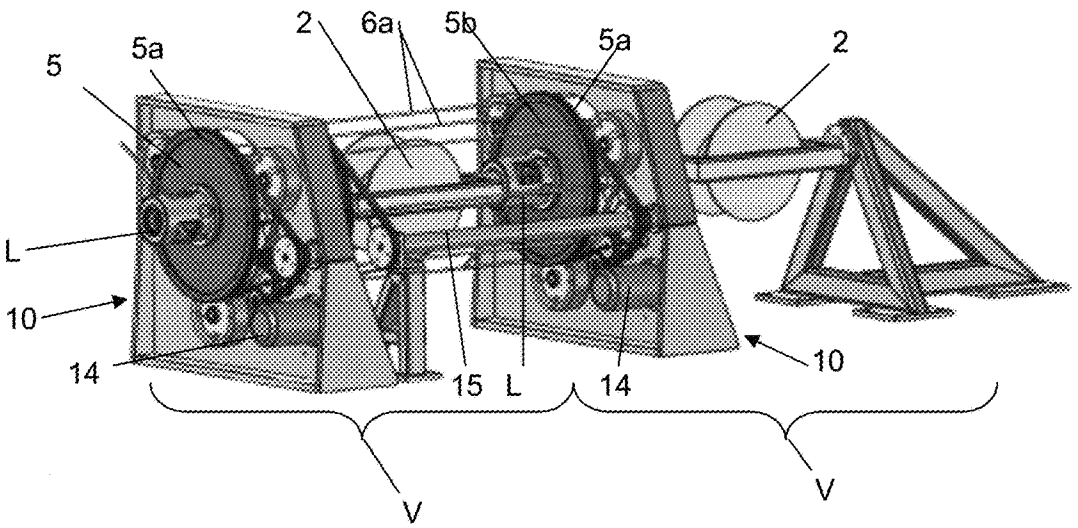
Figure 3:
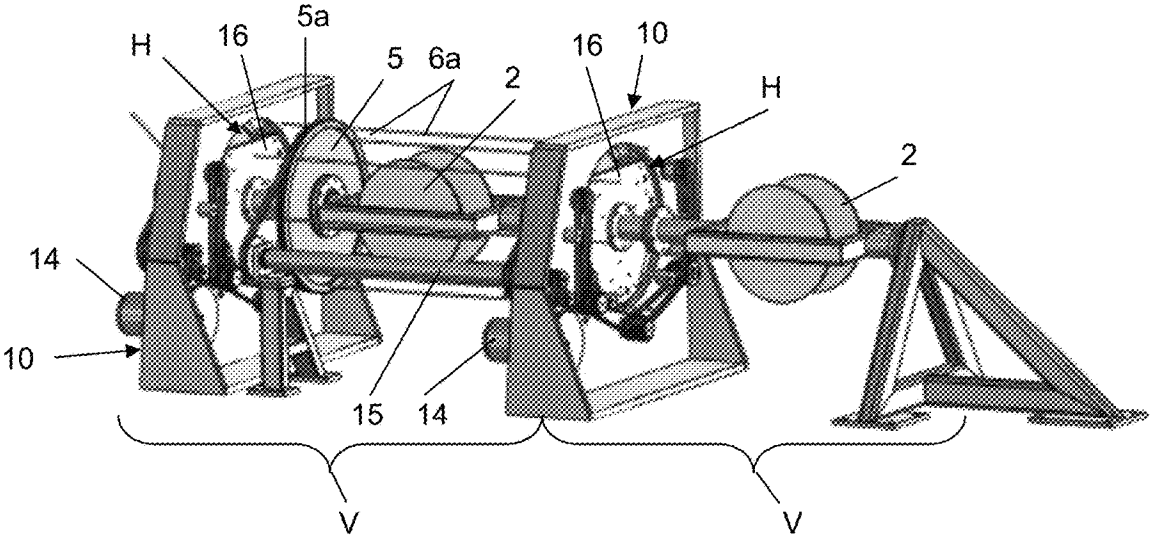
Figure 5:
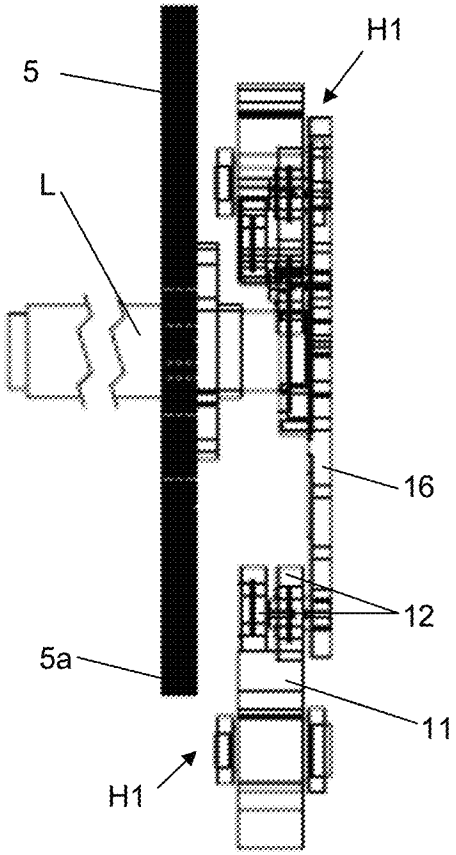
Figure 4:
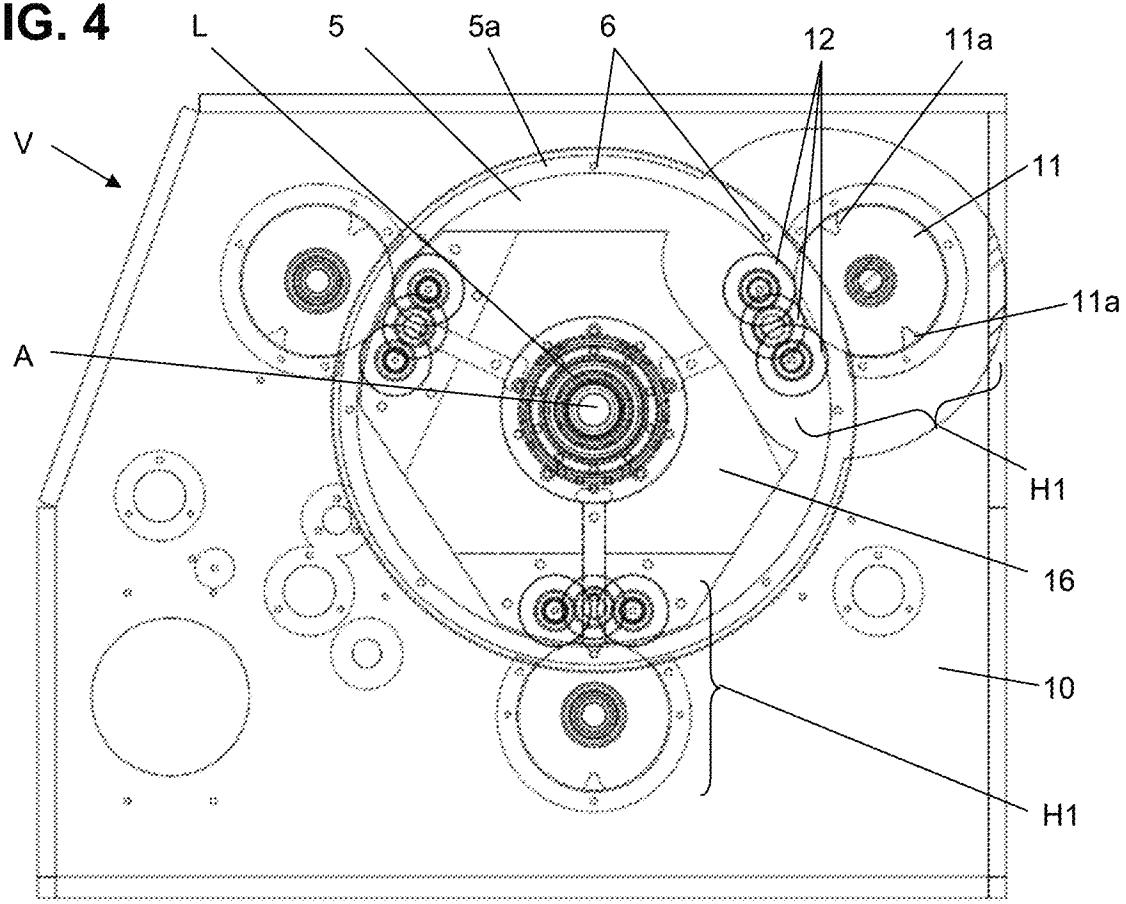
Figure 6:
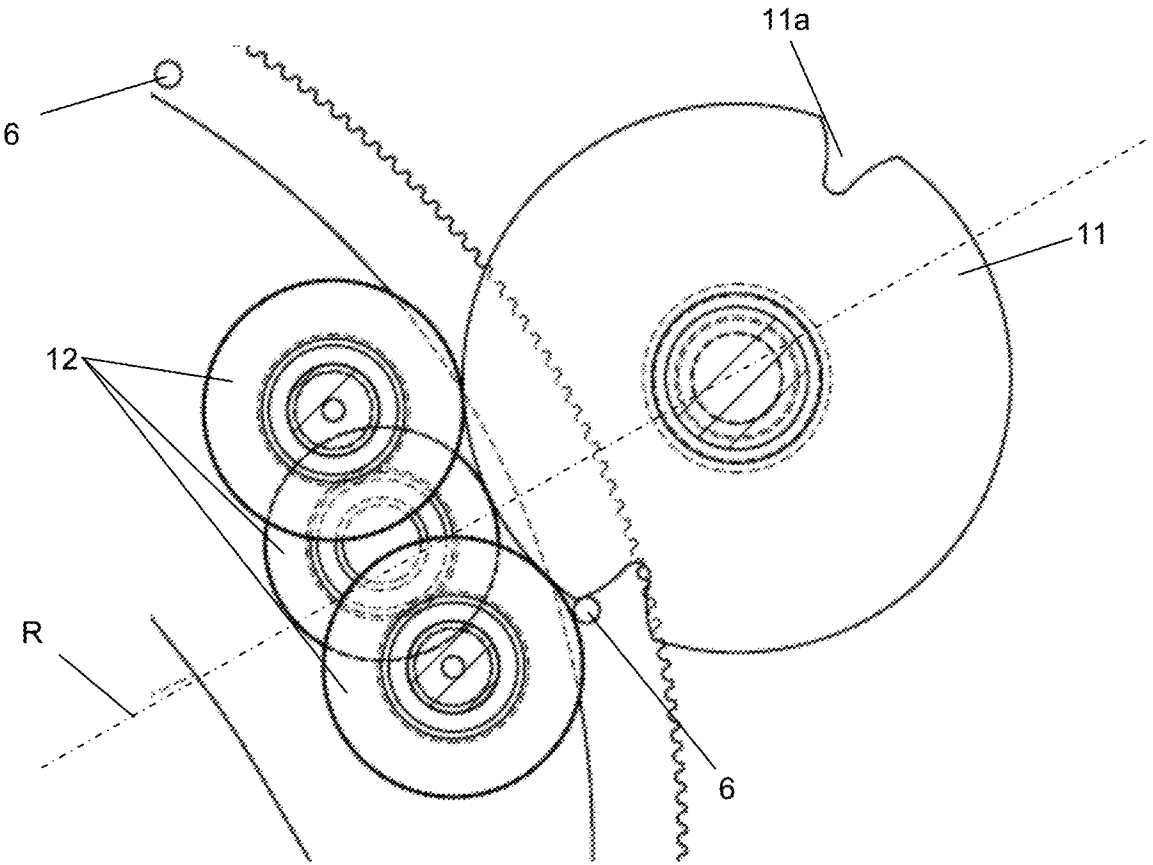
Figure 7:
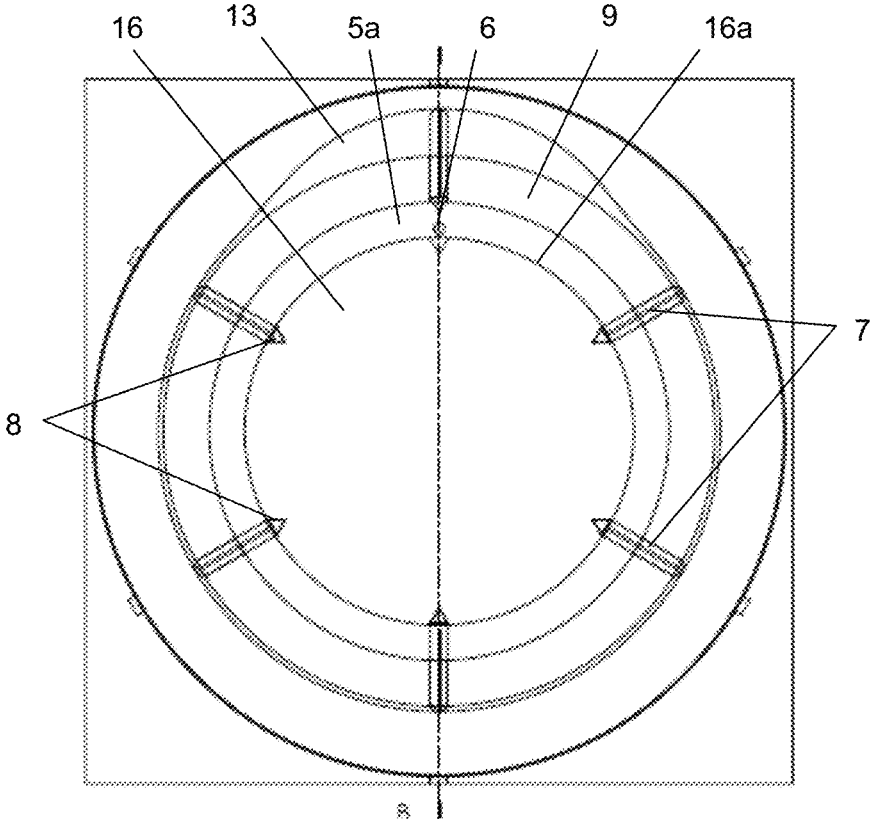
Figure 8:
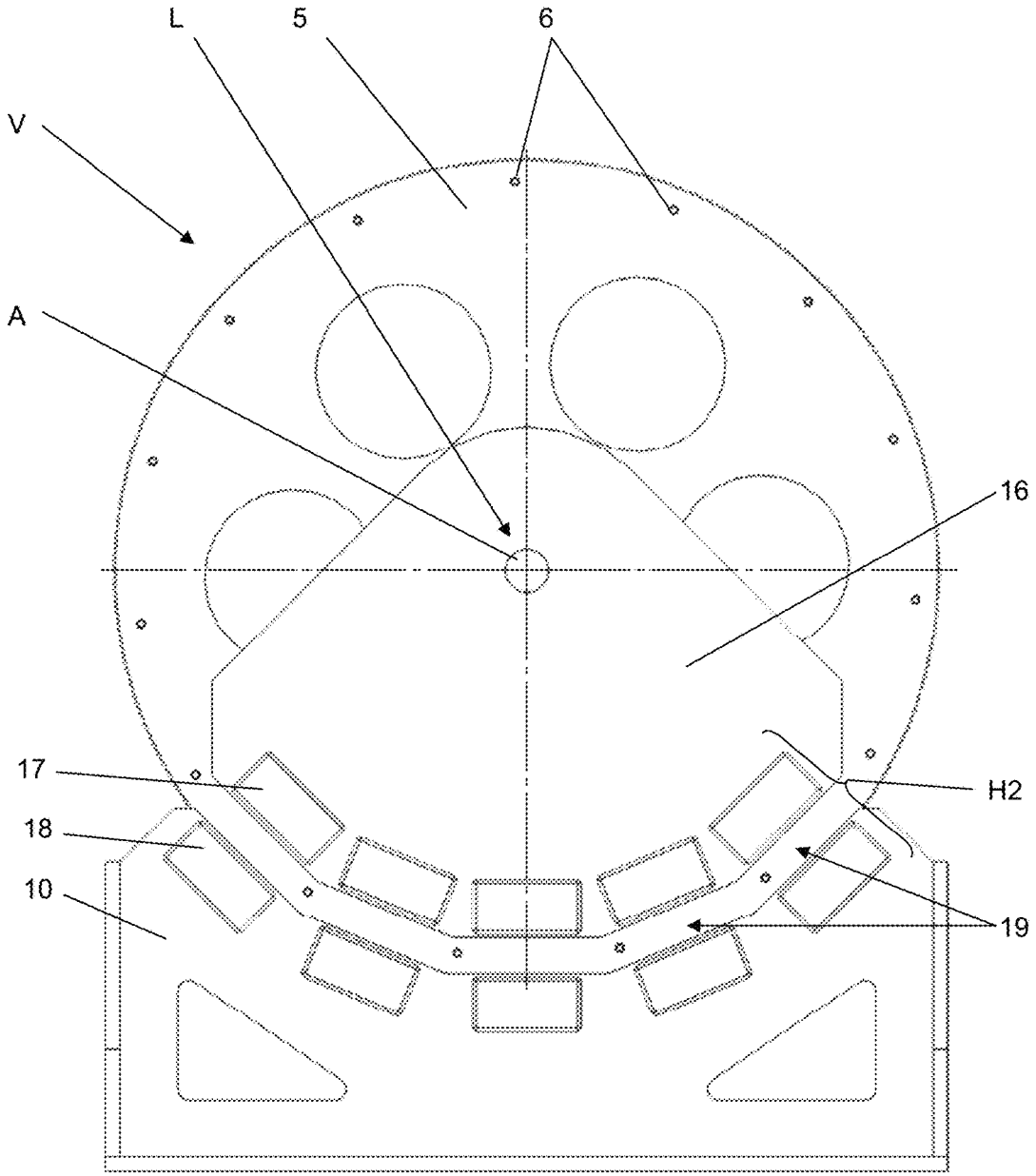

In the drawings:

FIG. 1 a tubular stranding machine according to the prior art,

FIG. 2 a stranding machine including two stranding elements in a perspective view from the front at an angle, FIG. 3 the stranding machine of FIG. 2 in a perspective view from the rear at an angle, FIG. 4 an illustration of the essential components of a version of a stranding element including three roller retaining arrangements in an axial view, FIG. 5 an illustration of the stranding element and of the retaining arrangements of FIG. 2 from radial direction, FIG. 6 a detailed view of one of the roller retaining arrangements of FIG. 4 in enlarged scale, and FIG. 7 a schematic illustration of a further version for a stranding element including bar-retaining arrangements, and FIG. 8 a schematic illustration of a stranding element including a stranding disk mounted via magnetic bearings according to the invention.

FIG. 1 shows a common tube stranding machine, as it is used for producing stranded cables, for example, of a plurality of individual conductors. The individual conductors can be electrical lines, steel, copper or aluminum wires as well as insulated conductors, wherein the shape of the cable is determined by the number of the individual conductors, the arrangement of the individual conductors and the length of twist. In the course of the continuous stranding tube 1, storage containers 2 for the material to be stranded are preferably mounted on coils, that are mounted on coil supports, which are suspended so as to oscillate. The material to be stranded is guided away from the storage containers 2 on the outside of the stranding tube 1 and to the stranding region 3 along the stranding tube 1. Due to the large length of the significant weight of the stranding tube 1, the latter must be mounted in a plurality of bearing stands 4, wherein a drive device is also located in at least one of the bearing stands 4 in order to set the stranding tube 1 in its entirety into rotation and in order to also decelerate it again.

A specific version of a stranding machine according to the present disclosure is illustrated in FIGS. 2 and 3 in an overall view. Instead of a stranding tube 1, provision is made here for two, but in principle for any amount of stranding elements V. Instead of a hollow-cylindrical tube section, provision is made as support for at least one rotating guide 6 (see FIGS. 4, 6 and 7) for the material of each stranding element V to be stranded for a thin stranding disk 5, which is preferably thin as compared to the diameter thereof, in the outer circumferential region 5*a* of which provision is made for at least one hole, which permeates the thickness thereof and which is used as rotating guide 6.

The stranding disk 5 or any possible other guiding device, such as for example in segment of a stranding tube 1, is rotatably mounted in a bearing arrangement L, that is located completely within the circle of rotation of the material. That curve, on which every longitudinal section of the material moves in the course of the rotation of the stranding disk 5, of the stranding tube segment, of the guide 6, etc., without thereby considering the longitudinal movement of the material, is to be considered to be the circle of rotation of the material.

The stranding disk 5 may be rotatably mounted on a central axis A, which axis A is embodied on the bearing arrangement L. Preferably, the axis A is embodied on the stranding disk 5 and is rotatably accommodated in the stationary bearing arrangement L.

A support element 9 for a stationary and rotatably fixed axis A, on which the stranding disk 5 is rotatably mounted, may preferably be supported via three retaining arrangements H on the support structure 10, wherein the retaining arrangements H are preferably arranged so as to be distributed evenly in circumferential direction of the stranding disk 5. The retaining arrangements H are furthermore preferably arranged in the region of the outer circumferential edge 5*a* of the stranding disk 5. They support the support element 9 stationarily on the support structure 10 of the stranding element V at any point in time, but thereby allow the material to pass through in circumferential direction during the rotative movement of the respective guide 6 of the stranding disk 5 past the retaining arrangement H.

The stranding disk 5 is set into rotation by a drive 14 and a toothed wheel or toothed belt drive on or in the support structure 10; or is decelerated, respectively; and a possible auxiliary stranding disk 5*b* is also driven by this drive 14 via a shaft 15 and, if applicable, also via toothed wheels, toothed belts, etc. The auxiliary stranding disk 5*b* may also be connected to a driven stranding disk 5 without its own drive, but in a rotatably fixed manner in return.

The bearing arrangement L is retained in a support structure 10 by means of a retaining arrangement H, wherein the retaining arrangement H extends radially beyond the circle of rotation of the material and is furthermore axially spaced apart from this respective guiding device 1, 5 in the direction of the rotational axes A of the stranding disk 5, of the stranding tube 1, etc. According to the present disclosure, the retaining arrangement H furthermore has a passage, which opens temporarily for the material to pass through in circumferential direction and which corresponds to the circle of rotation of the material, which first allows the central mounting of the guiding device 1, 5 in a structure located outside of the circle of rotation.

At least one guiding tube 6*a*, the end of which is supported in an auxiliary stranding disk 5*b*, may start at each guide 6, which auxiliary stranding disk 5*b* is rotatably arranged on the side of the stranding element V located opposite the storage container 2. At best, the auxiliary stranding disk 5*b* can also be foregone, wherein the guiding tubes 6*a* may then reach all the way to the stranding disk 5 of the stranding element V, which follows in the direction of the rotational axis A of the stranding elements V. In every rotational state of the stranding element V, the guiding tubes 6*a* lead the material to be stranded securely past the storage container 2, the coil carrier thereof, etc. At best, the guiding tubes 6*a* can extend at least to the next retaining arrangement H for the stranding disk 5 on the side of the stranding disk 5 located opposite the storage container 2. At best, at least one guiding tube 6*a* may also be devised in the wall of a cylinder tube, which, however, is then rotatably mounted in the central bearing arrangement L exactly in the same way as the stranding disk 5 via an axis on at least one front side of the cylinder tube.

The retaining arrangement H of the embodiment of FIGS. 2 and 3 has a central region, that is preferably embodied in the form of a disk 16. This disk 16 is retained in the support structure 10, preferably parallel to the stranding disk 5. Across a part of its circumference, this disk 16 at least partially has a substantially circular circumferential edge, the radius of which is smaller than the radius of the circle of the rotation of the material to be stranded. This disk 16 is retained in a stationary and rotatably fixed manner in the support structure 10 located radially outside of the circle of rotation by means of at least two retaining devices H1 (see FIGS. 4 and 5) and thus supports the bearing arrangement L for the stranding disk 5 and the auxiliary stranding disk 5*b*, if applicable, in a stationary and rotatably fixed manner. According to the present disclosure, however, at least two of the at least two retaining devices H1 are always embodied with retaining effect in connection with the disk 16 such that a passage gap, which follows the circle of rotation of the material, is kept free for the material to be stranded, if a guide 6 is located in the vicinity of the respective retaining device H1.

As is illustrated on a larger scale in FIG. 4, every retaining device H1 comprises at least one roller 11, that is rotatably secured to the support structure 10, and at least a plurality of rollers 12, that are rotatably secured on the opposite component, that is, the support element 9, and which are spaced apart from one another in circumferential direction of the stranding disk 5. Advantageously, the axes of all of the rollers 11, 12 are parallel to one another and preferably parallel to the rotational axis A of the stranding disk 5. The contact points of the outermost rollers 12 in each case with an opposite roller 11 are furthermore located on sides of a radial connecting line R located opposite one another in circumferential direction between the rotational axis A of the stranding disk 5 and the axis of the opposite roller 11. The support element 9 and thus the stranding disk 5 is support in a stationary, yet rotatable manner in the support structure 10 of the stranding element V via the rollers 11, 12, which contact one another at every point in time.

So that, when rotating the stranding disk 5 and thus also the guides 6 for the material to be stranded, this material may be guided without impacting or damaging and also without influencing the retaining arrangement H in circumferential direction, provision is made on the outer circumference of the outer roller 11 for at least one recess 11*a* (see FIG. 6). At best, provision may also be made for a plurality of recesses 11*a*, wherein the number of the recesses 11*a* in the roller 11 is preferably proportional to the guides 6 on the stranding disk 5. The dimensioning of the recess is provided such that the material may be accommodated in this recess 11*a* in response to its movement along the circle of rotation guided by the guides 6 near the retaining devices H1 and can be transported past the rollers 12 in the course of the rotation of the roller 11 without being hindered and preferably without contact to the contacting opposite rollers 12, and can thus pass the retaining arrangement H in an unhindered manner.

At best, the arrangement of the rollers 11, 12 may also be reversed, so that the roller or every roller 11 comprising recess 11*a* is connected to the support element 9, while the opposite rollers 12 are mounted to the support structure 10 of the stranding element V.

In circumferential direction of the roller 11, the course of the recess 11*a* extends across a region, that may be less than or equal to the distance of the contact points of the two opposite rollers 12 furthest away from one another with this roller 11 comprising recess 11*a*. For an even quieter run, the above-defined width of the recess 11*a* may be preferably less than or equal to the distance of the contact points of the two opposite rollers 12 located closest to one another with this roller 11 comprising recess 11*a*. It is thus ensured that the roller 11 is in contact with at least one of two opposite adjacent rollers 12 at any point in time. For a recess 11*a*, the longitudinal extension of which is parallel to the axis of at least the roller 11, the width of the recess 11*a* in circumferential direction of the roller 11 may be smaller than corresponds to the smallest distance of the contact points of the opposite rollers 12 along the circumference of the roller 11 including the recess 11*a*. It is thus likewise ensured for this concrete arrangement that the roller 11 including the recess 11*a* is in contact with at least two opposite rollers 12 at any point in time.

A further version of the roller 11 including the recess 11*a* may provide an orientation of the longitudinal extension of the recess 11*a* in the direction of the thickness of the roller 11, which is at an angle with regard to the axis of this roller 11. The axis of the recess 11*a* thus follows equidistantly to the shape of a screw about the rotational axis of the roller 11. Preferably, the ends of the recess 11*a* are thereby spaced apart by at least the circumferential width of the recess 11*a* in circumferential direction of the roller 11, and the roller 11 is in contact with every opposite roller 12 at any point in time, even when the material runs through the recess 11*a*. The entrance region into the recess 11*a* for the material thereby trails the exit region on the opposite side of the roller 11 in the direction of rotation of the roller 11. Even in the case of retaining devices H1 in each case only comprising one roller 11 on the support structure 10 and an opposite roller 12, the continuous contact of the rollers 11, 12 with support effect may thus be guaranteed simultaneously with the possibility of the lead-through of the material at any point in time and in every rotational state of the rollers 11, 12.

At least the rollers 11 including the recess 11*a* of the retaining devices H, preferably also the opposite rollers 12, are preferably driven at an angular velocity, that is proportional to the angular velocity of the stranding disk 5 and the number of the guides 6 as well as the number of the recesses 11*a*, so that the predetermined circumferential speed of the stranding disk 5 as well as the continuous unchangeable relative position of recesses 11*a* and guides 6 may be ensured at any point in time. Preferably, a functional drive-related connection between the drive 14 of the stranding disk 5 and the rollers 11, 12 exists for this purpose, for example by using drives including toothed wheels, toothed belts or the like. However, separate drives including only a mutual adjustment of the angular velocities via the electrical or electronic controls of these drives are also possible.

The electrical contacting of components or component groups of the stranding element V may preferably also be accomplished via at least one of the retaining arrangements H1. For this purpose, at least one roller 12, that is connected to the retaining arrangement H, may be connected to current consumers and/or sensor systems and/or actuators on the stranding element V, and at least one roller 11 on the support structure 10 may be connected to current and/or data lines of and/or to external current sources, evaluation, control or display units or the like, wherein the energy or the signals, respectively, may be transmitted via the contact between these rollers 11, 12.

As is illustrated in FIG. 4 as well as in FIG. 7, the retaining devices H1 may be distributed evenly along the circumference of the central region of the retaining arrangement H. At best, arrangements comprising tighter support of the bearing arrangement L are also possible in the regions, in which higher stresses occur, for example caused by the weight of the elements of the stranding element. Versions including at least two retaining arrangements H only below the horizontal plane through the rotational axis would thus also be possible, against which lower retaining arrangements H, the components supported thereby are acted upon via the weight force.

A different version for the retaining arrangements H is illustrated in FIG. 7. According to this alternative, the central region, that is, the disk 16 of the retaining arrangement H may thus be fixed in a stationary and rotatably fixed manner in a retaining ring 9 located radially outside of the circle of rotation via a plurality of retaining elements 7, which are preferably arranged so as to be distributed evenly along the circumference of the disk or the retaining ring 9, respectively. To securely fix the central element 16, provision is also made here for at least two retaining elements 7 to always connect the central disk 16 to the retaining ring 9.

Every guide 6 for the material, which comes from the storage container 2 and which is transported to the stranding region 3, is provided radially in the outermost circumferential edge region of the stranding disk 5, wherein a plurality of guides 6 are preferably distributed evenly about the circumference of the stranding disk 5.

Each of the retaining elements 7 is now embodied as a pin 7, that may be moved substantially radially and in its longitudinal extension and which engages with corresponding holes 8 in the outer circumferential edge 16*a* of the central disk 16 in the retained position. The retaining element 7 may thereby preferably be pretensioned towards the retained position, but may also be connected to an active drive for the radial movement thereof between the retained position and a position at a distance to the circumferential edge 16*a* of the central disk 16.

At least for the former version, the stranding disk 5 is provided with a cam-like structure 13 at least in the region of the guide or is coupled thereto in a rotatably fixed manner. This cam-like structure 13 engages indirectly or directly with the retaining element 7 and brings it from its retained position into a position, that is spaced apart from the retaining ring 9, if applicable against its pretension. At best, the stranding disk 5 according to a further version may be connected to a positive guide, which extends across the entire circumference, which positive guide cooperates with the retaining elements 7, in order to bring them from the retained position into a position, that is spaced apart from the retaining ring 9, depending on the relative position of the guides 6 to the retaining elements 7, when the guide 6 passes the respective retaining element 7. The retaining element 7 will otherwise and across the remaining circumferential region also be retained in retained position via the positive guide in order to ensure the desired secure retaining function. An electrical or electronic control of the movement of the retaining elements 7, or a direct connection to the drive of the stranding disk 5 would also be possible.

In the case of versions according to FIG. 7, at least two retaining elements 7 also always fix the central disk 16 at any point in time, wherein each retaining element 7 however, in the vicinity of which a guide 6 for the material is located at the moment, moves out of the region of the circle of rotation of the material to be stranded and a passage gap in circumferential direction is thus released for the material to be stranded. A further version, which ensures a secure fixing of the arrangement, which supports the stranding disk 5, and which now ensures a passage for the material to be stranded, which is open at any point in time, provides for the use of magnetic bearings. The material to be stranded may pass through between the two opposite parts of the magnetic bearing upon movement along the circle of rotation without being hindered, while the position of the retaining arrangement H for the stranding disk 5 is fixed securely.

At least one of the retaining elements 7 may be designed to electrically contact the central disk 16, so that, by connecting this central region of the retaining arrangement H to current consumers and/or sensor systems and/or actuators on the stranding element V, they may be supplied with energy or a data and control communication comprising external evaluation, control or display units or the like may be established, respectively.

FIG. 8 illustrates a version according to the present disclosure, the retaining arrangement H of which has a central region, that may be embodied in the form of a plate 16, for example, and which is preferably arranged parallel to the stranding disk 5. The radially outermost region relative to the rotational axis A is located within the circle of rotation of the material, in any event. The central region in a support structure 10 located radially outside of the circle of rotation is retained in a stationary and rotatably fixed manner in any event via at least one retaining device H2.

This retaining device H2 includes at least one magnetic bearing, that includes at least two magnetic devices 17,18 located opposite one another. Preferably, the magnetic bearings 17,18 are embodied as active magnetic bearings, in the case of which the bearing force is generated via regulated electromagnets in at least one of the magnetic devices 17, 18 and the stability of the system is ensured via a suitable feedback and electronic control. The constant electrical power supply required for active magnetic bearings as well as the mechanical safety bearing preferably provided for securing purposes in the case of electrical power outages or control system failures, which mostly consists of a loose ball or slide bearing, is not illustrated in FIG. 4. Active magnetic bearings in combination with permanent magnets are particularly advantageous thereby. Electrodynamic magnetic bearings with generation of the bearing force by means of eddy currents, mostly without electronic control, could furthermore be provided as well.

It goes without saying that, in principle, passive magnetic bearings may also be used for the retaining devices H2, if they are designed using diamagnetic materials and if these passive magnetic bearings are in actuality realized as "supraconductive magnetic bearings".

Between magnetic devices 17, 18 located opposite one another, an air gap 19 is present, which can preferably be adjusted via the regulation in the case of active magnetic bearings and which extends substantially along the circle of rotation of the material. This air gap 19 could also be created by means of an air bearing, in the case of which pressurized air forms the lubricant of the parts, which are removed relative to one another. The air gap 19 may thereby either follow the shape of the circle of rotation, that is, it can extend across a circumferential section of the circle of rotation. In this case, the air gap 19 of the magnetic bearing 17, 18 of the retaining device H2 also extends directly along a circumferential section of the stranding disk 5. Substantially straight, flat air gaps 19—such as, for example, for the plurality of magnetic bearings 17, 18, that are preferably distributed in the lower region of the retaining arrangement H along a circumferential section of the stranding disk 5—are preferably oriented parallel to the tangent at a point of the circle of rotation, which point is located in the region of the respective magnetic bearing 17, 18. It goes without saying that, in this case, the air gap 19 must be so large that the radial change of distance of the material to be stranded may take place when passing through the circle of rotation between gap entry and gap exit without contacting the air gap 19 on the inside.

The use of permanent magnets (not illustrated), by adjusting the lifting force thereof—regardless of whether above or below the components 5, 16 to be stored—to the weight of the components 5, 16, may be used to accommodate the majority thereof, and to leave only the fine adjustment to the active magnetic bearing 17, 18.

When using magnetic bearings, it also lends itself to adjust or to limit, respectively, the axial movability of the stranding disk 5 in the bearing of the bearing arrangement L and/or the axial play within the retaining devices H2 via magnetic axial bearings (not illustrated). In addition to the above-described radially-acting magnetic bearings, the retaining device H and/or the retaining device H2 also preferably has at least one magnetic axial bearing for this purpose.

Magnetic bearings 17, 18 may also preferably be distributed evenly along the circumference of the central region of the retaining arrangement H in the same way as any type of bearing arrangements or retaining devices, respectively. At best, arrangements comprising tighter support of the bearing arrangement L in those regions, in which increased stresses occur, for example due to the weight of the elements of the stranding element V, are also possible. Magnetic bearings 17, 18 could thus only be arranged below the horizontal plane through the rotational axis A, against which lower retaining device H2 the components supported thereby are impacted via the weight force. The magnetic bearings could also be distributed in a retaining ring located radially outside of the circle of rotation for stationarily and rotatably fixedly fixing the central region of the retaining arrangement H.

A stranding machine, in the case of which the number and concrete design of the individual stranding elements may be chosen depending on the required number and characteristics of the strands to be stranded, may be constructed from the currently described stranding elements V in a modular manner. Individual stranding elements V may also be removed and/or replaced easily and quickly for maintenance and repair. Due to the fact that a certain minimum number of strands to be stranded is to be provided for the most part, a corresponding number of stranding elements V according to the present disclosure may be connected to one another in a rotatably fixed manner to form a jointly operable unit. This unit may also have a common drive for all stranding elements V.

A combination of the above-described stranding elements with a common tubular stranding machine is also possible. Typically, the tubular stranding machine is thereby arranged so as to be located closest to the stranding region, while one or a plurality of stranding elements according to the present disclosure may connect thereto. Depending on the available number of strands to be stranded, the number of the stranding elements V, which follow the tubular stranding machine, may be chosen randomly. A lower number of these structural units may thus be operated in spite of a certain number of available storage containers 2 for the material to be stranded and in spite of a corresponding number of guiding devices 1, 5, 6, 6*a*.

LIST OF REFERENCE LABELS

1 stranding tube
2 storage container
3 stranding region
4 bearing stand
5 stranding disk
5*a* outer circumferential edge
5*b* auxiliary stranding disk
6 guide
6*a* guiding tube
7 retaining element
8 hole
9 retaining ring
10 support structure
11 roller
11*a* recess
12 roller
12 cam-like structure
14 drives
15 connecting shaft
16 central disk/plate
17 upper magnetic device of the magnetic bearing
18 lower magnetic device of the magnetic bearing
19 air gap of the magnetic bearing
H1 retaining device
H2 retaining device comprising magnetic bearing
V stranding element
R radial direction
A rotational axis
L bearing arrangement

What is claimed is:

1. A stranding element comprising at least one storage container for the material to be stranded and comprising at least one rotating guiding device for the material in order to guide the material from the storage container in the direction of the stranding region, wherein the guiding device is rotatably mounted in a support structure, characterized in that the at least one guiding device is rotatably mounted by means of a bearing arrangement, which bearing arrangement is located completely within the circle of rotation of the material and is secured to the support structure via at least one retaining arrangement, which extends from the bearing arrangement radially outwards beyond the circle of rotation of the material and which is axially spaced apart from the guiding device, which retaining arrangement has a roller with at least one passage, said roller being driven such that the at least on passage in circumferential direction is thus released for the material to be stranded in order to allow the material to pass through in circumferential direction and which follows the circle of rotation of the material.

2. The stranding element according to claim 1, characterized in that the guiding device comprises a stranding disk, which is rotatably mounted in the bearing arrangement, comprising at least one guide for the material to be stranded, wherein a guiding tube extends from each guide at least on the side of the stranding disk axially opposite the retaining arrangement, which guiding tube is supported in an auxiliary stranding disk of the stranding element or of a further stranding element, which follows in the direction of the rotational axis; and at least one guiding tube is devised in the wall of a rotative cylinder tube, wherein the rotational axis of the cylinder tube is rotatably mounted in a bearing arrangement on at least one front side.

3. The stranding element according to claim 1, characterized in that the retaining arrangement has a central region parallel to a stranding disk and comprises a circumferential edge comprising a smaller radius than the circle of rotation of the material, wherein the central disk is retained in a stationary and rotational manner in a support structure located radially outside of the circle of rotation by means of at least two retaining devices, wherein at least one of the retaining devices always retain the central disk and each retaining device, in the vicinity of which a guide for the material is currently located, releases a passage gap for the material to be stranded.

4. The stranding element according to claim 3, characterized in that the central region of the retaining arrangement is fixed in a stationary and rotatably fixed manner in a retaining ring located radially outside of the circle of rotation via a plurality of retaining elements, which are arranged so as to be distributed evenly along the circumference of the retaining ring, wherein at least two retaining elements always connect the central disk to the retaining ring, and each retaining element, in the vicinity of which a guide for the material is currently located, is moved out of the region of the circle of rotation of the material, and releases a passage gap for the material to be stranded.

5. The stranding element according to claim 3, characterized in that the retaining element is a pin, which can be moved radially and in its longitudinal extension and which is mounted in the central disk or the retaining ring, and which engages with corresponding holes in the radially opposite component in retained position, wherein the retaining element is pretensioned towards the retained position.

6. The stranding element according to claim 3, characterized in that, at least in the region of the guide, the stranding disk is provided with a cam-like structure or a positive guide, which brings the retaining element located upstream of the guide in rotational direction from its retained position out of the region of the circle of rotation, as soon as the guide passes the retaining element and retains the retaining element in retained position.

7. The stranding element according to claim 1, characterized in that the retaining arrangement comprises a central region which central region is retained in the support structure in a stationary and rotatably fixed manner by means of a plurality of radially outward retaining devices, which extend from the central bearing arrangement radially outwards via retaining devices extending beyond the circle of rotation, wherein these retaining devices are arranged so as to be distributed evenly in circumferential direction of the retaining arrangement in the region of the circle of rotation of the material, and wherein the retaining devices support the central disk in the support structure at any point in time, yet thereby allowing the material to pass through in circumferential direction of the disk.

8. The stranding device according to claim 7, characterized in that each retaining device comprises at least one roller, which is rotatably secured to the central region onto the support structure, and at least one roller, which is rotatably secured on the respective opposite component wherein the axes of all rollers are oriented parallel to one another and parallel to the rotational axis of the stranding element, and wherein the contact points of the outermost rollers with an opposite roller are located on opposite sides in circumferential direction of a radial connecting line between the rotational axis and the opposite roller.

9. The stranding element according to claim 8, characterized in that provision is made on the outer circumference of one of the rollers, which protrude into the circle of rotation of the material, for at least one recess wherein this recess has a dimension to allow the material to be capable of being received in this recess (11*a*) and to be capable of being transported past these rollers in the course of the rotation of the roller, without hindering and without contact to the contacting opposite rollers.

10. The stranding element according to claim 8, characterized in that the expansion of the recesses in circumferential direction of the roller extends parallel to the rotational axes of the rollers beyond a region, which maximally corresponds to the smallest distance of the contact points of two adjacent opposite rollers with this roller comprising the recess, so that the roller comprising the recess is in contact with at least one of two opposite adjacent rollers at any point in time.

11. The stranding element according to claim 8, characterized in that the recesses in the roller run at an incline yet equidistantly as compared to the rotational axis, wherein the limitations of the recesses in circumferential direction of the roller are spaced apart by at least the circumferential width of the recesses, and the roller is in contact with every opposite roller at every point in time.

12. The stranding element according to claim 8, characterized in that at least the rollers comprising the recess can be driven with an angular velocity, which is proportional to the angular velocity of the stranding disk, wherein a functional drive-related connection exists between the drive of the stranding disk and the rollers.

13. The stranding element according to claim 4, characterized in that at least one of the retaining arrangements is designed to electrically contact components or component groups of the stranding element, and that either at least one roller is designed for this purpose with at least one of a current consumer, a sensor system, or an actuator on the stranding element or at least one roller of the support structure, respectively, or at least one of the retaining elements is designed to electrically connect the retaining ring to the central, and that the retaining ring is connected to at least one of a current consumer, a sensor system or an actuator on the stranding element or that the at least one retaining element is connected with at least one of a current line or a data line to at least one of an external current sources, evaluation unit, control unit or display unit, respectively.

14. A stranding element comprising at least one storage container for the material to be stranded and comprising at least one rotating guiding device for the material in order to guide the material from the storage container in the direction of the stranding region, wherein the guiding device is rotatably mounted in a support structure, characterized in that the at least one guiding device is rotatably mounted by means of a bearing arrangement, which bearing arrangement is located completely within the circle of rotation of the material and is secured to the support structure via at least one retaining arrangement, characterized in that the retaining arrangement has a central region, the largest outer radius of which is smaller than the circle of rotation of the material, wherein the central region is retained in a stationary and rotatably fixed manner in a support structure located radially outside of the circle of rotation by means of at least one retaining device, wherein each retaining device comprises at least one magnetic bearing comprising an air gap the air gap of which extends along the circle of rotation of the material, and the central region of the retaining arrangement is present in the form of a plate.

15. The stranding element according to claim 14, characterized in that at least one of the magnetic bearings extends along a circumferential section of the stranding disk and the air gap thereof follows the circle of rotation of the material across a corresponding circumferential section.

16. The stranding element according claim 14, characterized in that at least one of the magnetic bearings is embodied as active magnetic bearing, and at least one of the active magnetic bearings is combined with least one permanent magnet, which is matched to the weight of the stranding element, and the retaining arrangement has at least one magnetic axial bearing.

17. A stranding machine comprising a plurality of storage containers, which are stationary during operation, for the material to be stranded and comprising at least one rotating guiding device for the material in order to guide same from each of the storage containers to a common stranding region, characterized in that at least one of the storage containers and a corresponding guiding device are elements of a stranding element according to claim 1.

18. The stranding machine according to claim 17, characterized in that this stranding element can be operated and handled independent from other stranding elements and is a functional and structural unit.

19. The stranding machine according to claim 17, characterized in that two or a plurality of stranding elements are connected to one another in a rotatably fixed manner.

20. The stranding machine according to claim 17, characterized in that the guiding device for a plurality of storage containers is formed from a stranding tube, which is mounted so as to be capable of rotating about its longitudinal axis, in the interior of which the storage containers for the material to be stranded are supported so as to oscillate relative to the stranding tube, and that at least one further stranding element, which can be operated and handled separately and independently from the stranding tube, is provided.

* * * * *